US008402929B2

(12) United States Patent
Marsh et al.

(10) Patent No.: US 8,402,929 B2
(45) Date of Patent: Mar. 26, 2013

(54) COOLING SYSTEM AND METHOD

(75) Inventors: Gregory Alan Marsh, Erie, PA (US); Mahesh Chand Aggarwal, Erie, PA (US); Kendall Roger Swenson, Erie, PA (US)

(73) Assignee: General Electric Company, Schenectady, NY (US)

( * ) Notice: Subject to any disclaimer, the term of this patent is extended or adjusted under 35 U.S.C. 154(b) by 769 days.

(21) Appl. No.: 12/211,397

(22) Filed: Sep. 16, 2008

(65) Prior Publication Data

US 2009/0078219 A1 Mar. 26, 2009

Related U.S. Application Data

(60) Provisional application No. 60/974,842, filed on Sep. 24, 2007.

(51) Int. Cl.
*F01P 7/00* (2006.01)

(52) U.S. Cl. ..... 123/41.02; 123/563; 123/41.31; 123/41.33; 123/41.29; 123/41.51; 123/196 A; 123/196 B

(58) Field of Classification Search ..... 123/41.02, 123/563, 41.31, 41.33, 41.29, 41.51, 196 A, 123/196 B
See application file for complete search history.

(56) References Cited

U.S. PATENT DOCUMENTS

| | | | | |
|---|---|---|---|---|
| 2,874,804 | A * | 2/1959 | Haas | 184/6.13 |
| 3,638,760 | A * | 2/1972 | Lamm | 184/6.23 |
| 5,301,642 | A * | 4/1994 | Matsushiro et al. | 123/196 AB |
| 6,536,381 | B2 * | 3/2003 | Langervik | 123/41.33 |
| 6,604,515 | B2 * | 8/2003 | Marsh et al. | 123/563 |
| 6,938,605 | B2 * | 9/2005 | Al-Khateeb | 123/196 AB |
| 7,131,403 | B1 * | 11/2006 | Banga et al. | 123/41.31 |
| 7,617,679 | B2 * | 11/2009 | Kardos et al. | 60/605.2 |
| 7,806,091 | B2 * | 10/2010 | Esau et al. | 123/41.29 |
| 2002/0195090 | A1 | 12/2002 | Marsh et al. | |
| 2003/0029412 | A1 | 2/2003 | Kato et al. | |

FOREIGN PATENT DOCUMENTS

| | | |
|---|---|---|
| EP | 0 166 698 | 1/1986 |
| EP | 0 499 071 | 8/1992 |

* cited by examiner

*Primary Examiner* — Marguerite McMahon
*Assistant Examiner* — James Kim
(74) *Attorney, Agent, or Firm* — GE Global Patent Operation; John A. Kramer

(57) ABSTRACT

A system for cooling an engine on a vehicle without a coolant based intercooler and intermediate duct, the system including an air-to-oil radiator system configured to cool oil that flows through an engine, an air-to-air radiator system configured to cool air that flows through the engine and further configured to operate in conjunction with the air-to-oil radiator system to provide cool air for use with the air-to-oil radiator system, and a slow flow coolant radiator configured to cool a coolant provided to cool the engine and further provided to operate in conjunction with the air-to-oil radiator system. A method for cooling oil in an engine without a coolant based intercooler and intermediate duct is also disclosed.

11 Claims, 8 Drawing Sheets

COOLING SYSTEM AND METHOD

CROSS-REFERENCE TO RELATED APPLICATIONS

This application claims priority to U.S. Provisional Application No. 60/974,842 filed Sep. 24, 2007.

BACKGROUND OF THE INVENTION

The field of the invention relates generally to an internal combustion engine and, more particularly, to a system and method for cooling a turbocharged engine.

Internal combustion engines such as, but not limited to, turbocharged diesel engines as utilized with locomotives, require cooling systems to limit the temperatures of various engine components. Such engines are designed with water jackets and/or internal cooling passages for the circulation of a coolant to remove heat energy from the engine components, such as, but not limited to, the engine block and cylinder heads. Lubricating oil is circulated throughout the engine to reduce friction between moving parts and to remove heat from components such as the pistons and bearings. The lubricating oil must be cooled to maintain its lubricity and to extend the interval between oil changes.

Some internal combustion engines utilize turbochargers to increase engine power output by compressing the intake combustion air to a higher density. Such compression results in the heating of the combustion air, which must then be cooled prior to entering the combustion chamber to enable the engine to have high volumetric efficiency and low emissions of exhaust pollutants. For mobile applications such as, but not limited to, locomotives, it is known to use a pumped cooling medium such as water to transport heat to finned radiator tubes. The radiator tubes then transfer the heat to the ambient air, often using forced convection provided by a fan. This may be accomplished using a two stage intercooler for conditioning the combustion air entering the engine. A first coolant loop may include a first stage intercooler and a second coolant loop may include a second stage intercooler. This two stage system provides a level of control for maintaining the engine, lubricating oil and combustion air temperatures within respective limits without excessive fan cycling.

Means for lowering manifold air temperature (MAT) have been incorporated in turbocharged piston engine powered vehicles for many decades. Lowering MAT can increase the power available from a given size engine and/or increase the durability of the engine at very high power loads by limiting the temperatures to which components, such as aluminum pistons, are exposed. For light weight vehicles such as piston powered military aircraft and racing automobiles, the need is usually for a large reduction in MAT for a short period of time. For such applications it has been feasible to carry a small amount of water that is injected into the hot intake air when needed. The injected water changes to steam due to the high temperature, thereby absorbing heat and lowering the intake charge temperature. For heavy mobile vehicles such as, but not limited to, turbocharged diesel powered locomotives, which are designed to produce a maximum power output for an indefinite amount of time, it originally sufficed to use water based coolant circuits to transport the heat from an intercooler to a fan cooled radiator, with the coolant from the radiator used for both engine and intercooler alike.

Though internal combustion engines are used in locomotives, these engines are also used in a vast array of other applications where a prime mover is used, such as but not limited to off-highway vehicles, marine vessels, stationary power plants, agricultural vehicles, and transportation vehicles. Further reductions in NOx emissions are being required worldwide when prime movers are operated. In the case of stationary power plants and marine vessels utilizing diesel engines, it is still possible in many cases to meet reduced NOx limits with water based cooling systems that exchange heat to the environment using river, lake, or ocean water that rarely exceeds 26.67 degrees Celsius (80.01 degrees Fahrenheit).

However, the approach used with stationary power plants and marine vessels is not practical for a locomotive due to the need to haul the supply of water along with the train. Towards this end, to eliminate a need for a significant amount of coolant, locomotive and/or train operators and owners would benefit from having a cooling system that does not require a coolant based intercooler and/or intermediate ducts.

BRIEF DESCRIPTION OF THE INVENTION

Exemplary embodiments of the invention are directed towards a system and method for cooling an engine on a vehicle without a coolant based intercooler and intermediate duct. The system an air-to-oil radiator system configured to cool oil that flows through an engine. An air-to-air radiator system is provided to cool air that flows through the engine and further configured to operate in conjunction with the air-to-oil radiator system to provide cool air for use with the air-to-oil radiator. A slow flow coolant radiator is configured to cool a coolant provided to cool the engine and further provided to operate in conjunction with the air-to-oil radiator system.

In another embodiment, a system for cooling an engine on a powered system without a coolant based intercooler and intermediate duct is disclosed. The system has an air-to-oil radiator system configured to cool oil that flows through an engine. An engine oil sump is provided having a plurality of segregated regions to manage a flow of oil through the air-to-oil radiator system. The segregated regions are configured to maintain, restore and/or retain oil as determined by a temperature of the oil.

In yet another embodiment, a method for cooling oil in an engine without a coolant based intercooler and intermediate duct is disclosed. The method includes accumulating hot oil returning from an engine in a first region of an engine oil sump. Cool oil returning from one or more air-to-oil radiators is accumulated in a second region of the engine oil sump. Hot oil accumulated in the first region of the engine oil sump is directed through one or more air-to-oil radiators. A flow rate imbalance is managed therebetween the first region and the second region. A suction dynamic flow therebetween the first region and the second region is reduced.

BRIEF DESCRIPTION OF THE DRAWINGS

A more particular description of exemplary embodiments of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
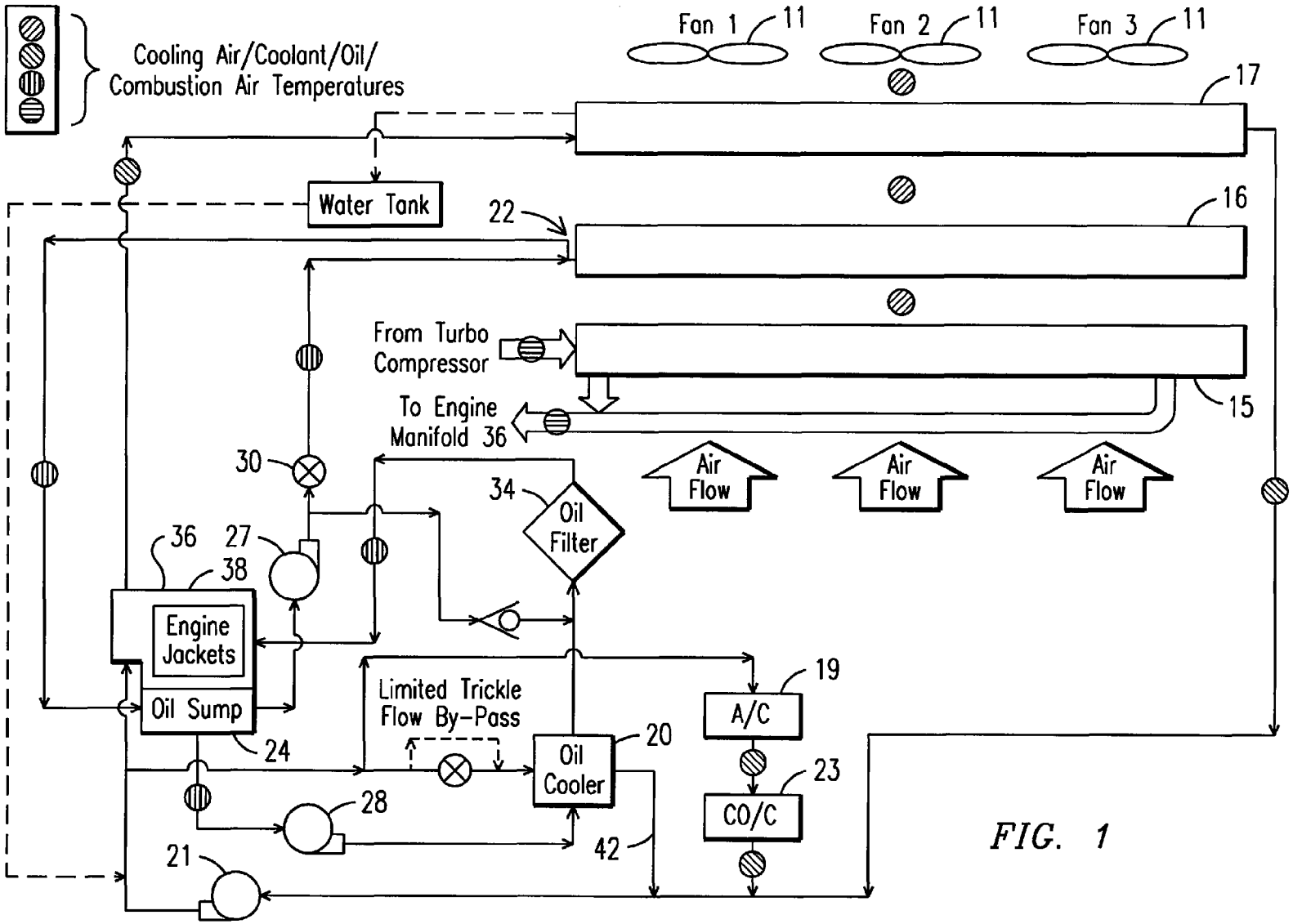
FIG. 1 depicts an exemplary embodiment of an integrated cooling system without a water based intercooler.

FIG. 1 depicts an exemplary embodiment of an integrated cooling system without a water based intercooler. As illustrated, fans 11 pull cooling air through three radiators 15, 16, 17. The first radiator 15 is an air-to-air radiator. In an exemplary embodiment it is a copper-brazed square fin radiator. An example of a copper brazed radiator is one that has a plate heat exchanger where the plates, or fins, are brazed to tubes. In an exemplary embodiment the second radiator 16 is a copper-brazed air-to-oil radiator. The third radiator 17 is a slow flow radiator, which uses a coolant, such as water and/or anti-freeze. As those skilled in the art are aware, a slow flow coolant radiator utilizes a method to get lower fluid temperature for a given heat transfer rate, or in other words, the coolant flow has been reduced so that it flows at a lower velocity through the radiator, or more specifically the tubes of the radiator.

Figure 2:
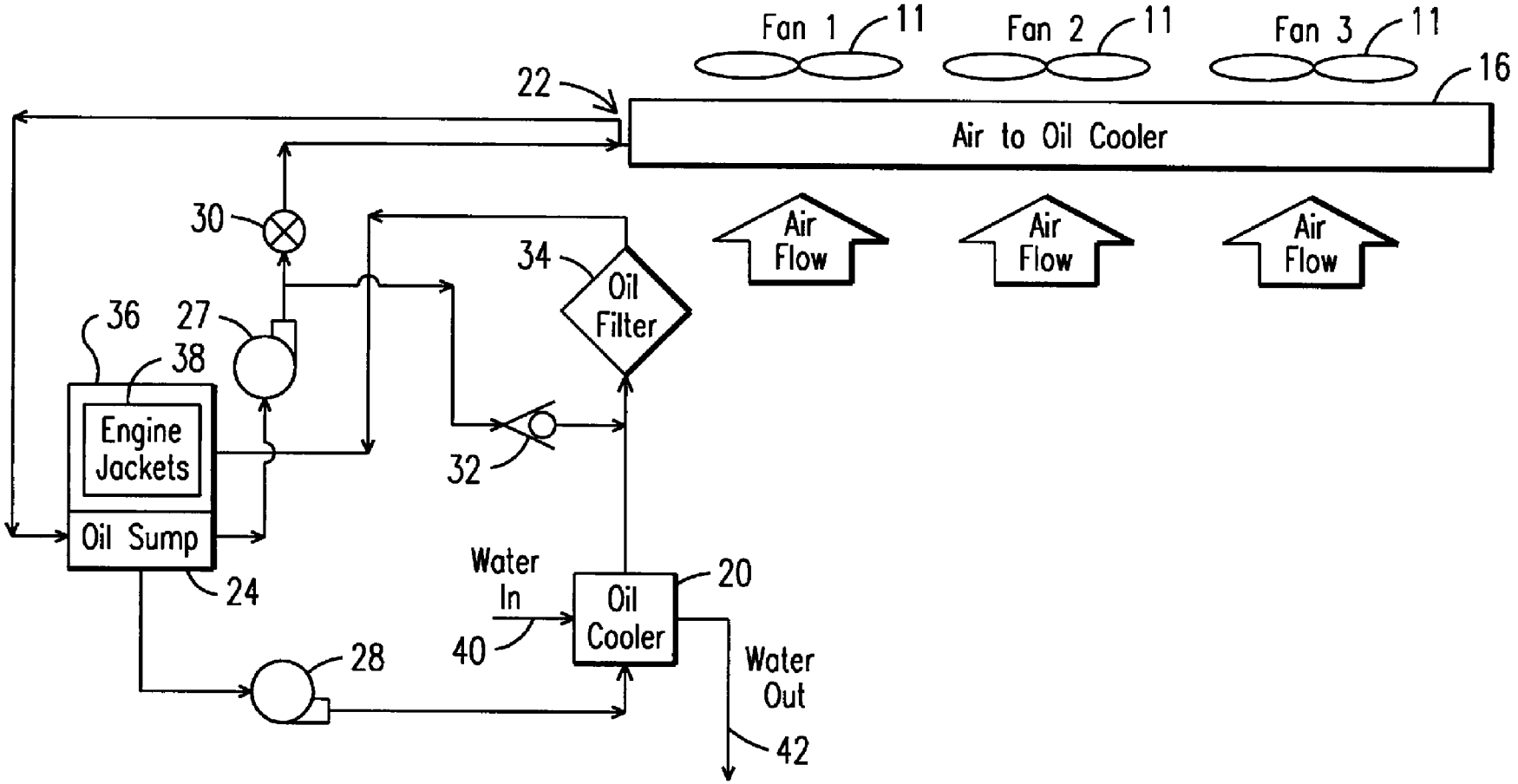
FIG. 2 depicts an exemplary embodiment of an air-to-oil cooling system.

In a first circuit, oil leaves the oil sump and flows into an oil pre-lube pump. FIG. 2 depicts an exemplary embodiment of an air-to-oil cooling system, more specifically the first circuit. As illustrated, an air-to-oil radiator/cooler 16 is provided. The fan(s) 11 pulls air through the radiator. Air-to-oil manifold piping 22 is provided so that the oil passes through the radiator 16. Oil leaving the radiator 16 is returned to an oil sump 24. Oil is then passed through a first engine-driven pump 27. This first pump 27 operates in tandem with a second engine-driven pump 28 discussed in more detail below.

The oil then is provided to an oil-cooling selector valve 30. This valve is used to divert oil from the air-to-oil radiator 16 while the locomotive is within a tunnel. When in a tunnel, the oil is directed to a pre-lube check valve 32. The oil is then provided to an oil filter 34 and then to an engine manifold 36 and/or engine 38 (e.g., through one or more engine jackets), which returns the oil to the oil sump 24. Oil is diverted during tunnel operation because air temperature is too high where using the air-to-oil radiator 16 is not going sufficiently cool the oil.

In another circuit, the oil is directed from the oil sump 24 to the second engine pump 28. The second engine pump 28 directs the oil to an oil cooler 20. The oil cooler 20 is supplied with an inlet 40 to accept water that is used to cool the oil and an outlet 42 to remove the water. The oil is then provided to the oil filter 34 and then to the engine manifold 36 and/or the engine 38, which returns the oil to the oil sump 24. A controller (not illustrated) is provided to determine which cooling configuration should be utilized.

As further illustrated in FIG. 1, coolant and combustion air from a turbo compressor are cooled with the first radiator 15. The resulting combustion air stream is directed to the engine manifold 36. This allows for high pressure coolant and low pressure air-to-air and air-to-oil cooling with integral cores and no water based intercooler.

As is also illustrated in FIG. 1, coolant in the third radiator 17 leaves the third radiator and by way of an engine coolant pump 21 is provided to cool the engine through the engine coolant jacket 38, and then returns to the third radiator. As disclosed herein, the coolant is further directed to other engine components to cool those components as well. For example, the coolant is also provided to an air compressor 19 and an after cooler/oil heater/cooler 23 and is then returned to the coolant stream.

Figure 3:
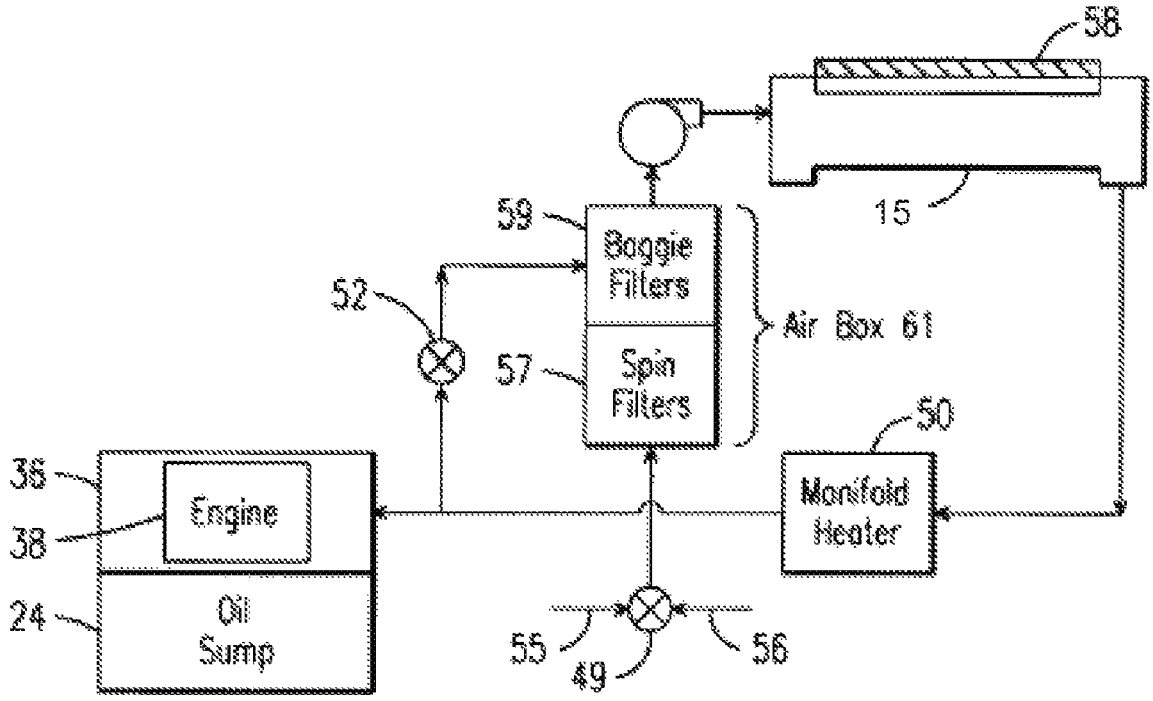
FIG. 3 depicts an exemplary embodiment of a manifold air circuit.

FIG. 3 depicts an exemplary embodiment of a manifold air circuit. In cold ambient conditions with little boost pressure (low load), manifold air may be cooled below a predefined temperature. Locomotives typically include an air box 61 having one or more filters, e.g., spin filters 57 and baggie filters 59, for filtering air to be provided to the engine. Winter/summer doors 49, which are in essence represented by whether engine room air 55 or radiator cab air 56 is used, will provide heat to the air box 61 to keep the filters 57, 59 free of ice. The warm air coming from the engine room will pass through the air box 61, which is illustrated as collectively by the spin filters 57 and baggie filters 59, and then will pass through the air-to-air heat radiator 15 cooling the air to possibly below the allowed temperature. Some re-heat of the air is possible from the proximity of the air-to-oil radiator 16, or by sending some warm oil to the air-to-oil radiator 16. This most likely will not be sufficient; therefore a manifold heater 50 may be needed to reheat the air to an acceptable temperature.

At high load and low ambient conditions the mass air flow may be too great, resulting in high cylinder pressures at higher horsepower. A waste gate valve 52 at the entrance to an engine manifold 36 is provided to lower the mass flow into the engine 38 so that full horsepower is maintained through all ambient conditions, excluding tunnel conditions. Providing the waste gate valve 52 could eliminate the manifold heater 50, as is further illustrated in FIG. 4.

Figure 4:
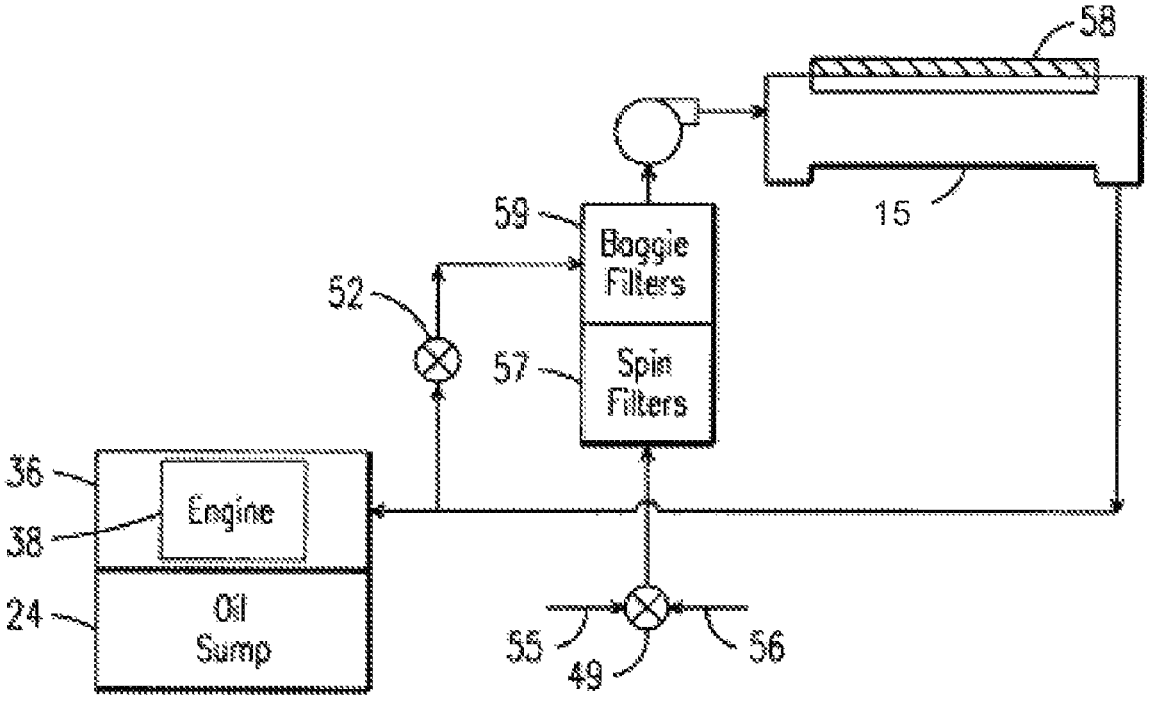
FIG. 4 depicts another exemplary embodiment of a manifold air circuit.

FIG. 4 depicts another exemplary embodiment of a manifold air circuit. Warm engine room air enters the air box and passes through the air-to-air radiator 15 cooling the intake air.

The selection of engine room air 55 or radiator cab air 56 could be determined by using automated shutters 58. Some re-heat of the air is also possible from proximity of the hot coolant radiator 17 or by sending some warm oil to the air-to-oil radiator 16, as illustrated in FIG. 1.

If air leaving the air-to-air radiator 15 is still below a specified temperature the waste gate valve 52 is opened. The manifold pressure should be below ambient pressure at idle and low loads. Opening the waste gate valve 52 will draw warm engine room air 55 from the baggie filters 59 and mix it with the still too cool manifold air providing some level of heating. As disclosed above, this combination could result in the elimination of the manifold heater 50.

Figure 5:
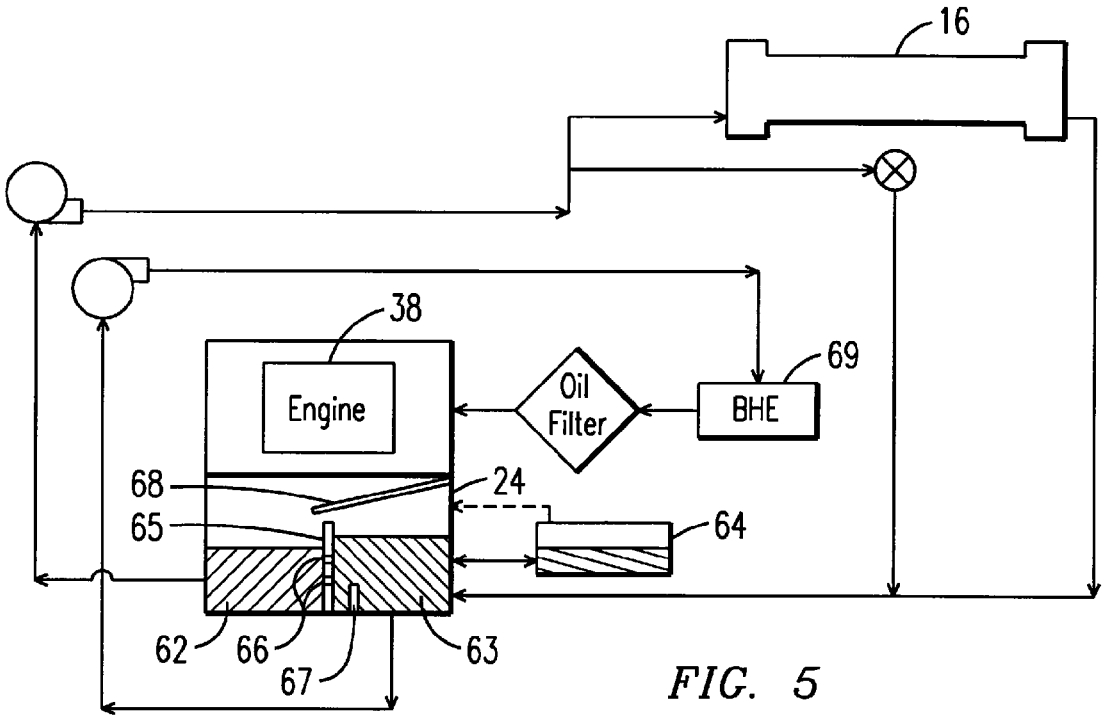
FIG. 5 depicts an exemplary embodiment of a lube oil circuit.

FIG. 5 depicts an exemplary embodiment of a lube oil circuit. As illustrated, the oil sump 24 has two segregated regions 62, 63. A first region 62 accumulates hot oil returning from the engine 38 and a second region 63 holds cooler oil returning from the air-to-oil radiator 16. Any pump flow rate imbalance is managed by allowing high oil levels to overflow a first thermal baffle 65 and/or pass through fluid communication holes 66 in the thermal baffle 65. Using this configuration allows for the hottest oil to be sent to the air-to-oil radiator 16 for cooling, thus maximizing the possible heat transfer for a given size of a radiator and ambient air temperature, whereas the coldest available oil can be used to provide engine lubrication. Thus, the communication holes 66 disposed through the baffle are used to equalize a flow rate imbalance that may be realized between the first region 62 and the second region 63. A second baffle 67 may also be included. The second baffle 67 is a lower height than the first baffle, or thermal baffle, 65 and is provided to prevent suction dynamic flow from pulling hotter oil through the communication holes 66 closer to the bottom of the oil sump 24.

Figure 6:
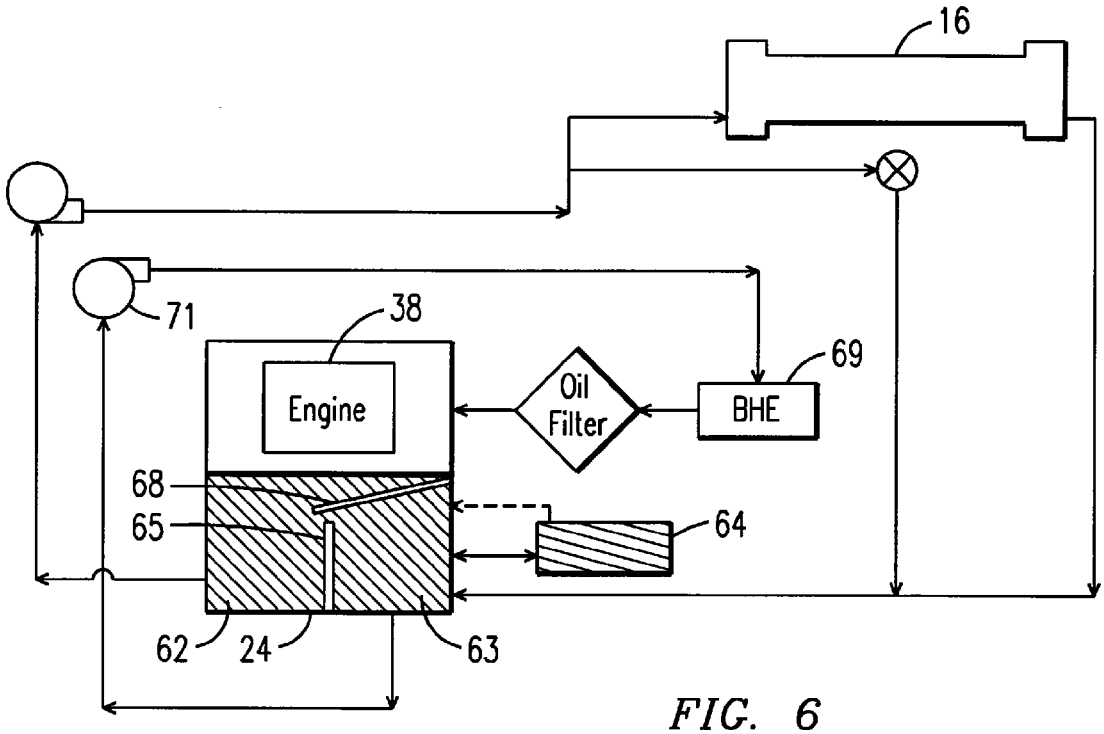
FIG. 6 depicts another exemplary embodiment of a lube oil circuit.

As is further illustrated, hot oil leaving the engine 38 falls into the oil sump 24, as acted upon by gravity and/or gravitational forces. Oil falling over the first region 62, or hot region, falls unhindered, but oil falling over the second region 63, or cold region, falls onto a "roof" sheet, or cover, 68 that directs the hot oil to the first region, or hot side, of the oil sump 24. The hot side oil is pumped out of the oil sump 24 and into the air-to-oil radiator 16 and after being cooled is returned to the second region 63 cold side of the oil sump 24. The second region 63, or cold region, of the oil sump is used to supply oil back into the engine 38. A surge tank 64 is also provided for overflow oil. Also disclosed in FIG. 5 and FIG. 6 is a brazed-heat exchanger (BHE) 69. The BHE 69 is a coolant-to-oil heat exchanger.

When the engine 38 is running and the air-to-oil system is running, the air-to-oil system is filled with oil that comes from the oil sump 24. The oil level in the oil sump 24 will eventually fall below the thermal baffle 65. The volume of oil in the surge tank 64 will remain level with the volume in the oil sump 24. The surge tank 64 could be tied to either the first region 62 or the second region 63 of the oil sump 24 to take advantage of the area with maximum drawdown depth. This could maximize the storage capability of the surge tank 64.

FIG. 6 depicts another exemplary embodiment of a lube oil circuit with a filled oil sump. When the engine is running and the air-to-oil system is not running, the air-to-oil system drains into both the oil sump 24 and the surge tank 64. This will raise the oil sump 24 level and the level of oil in the surge tank 64 the same vertical distance due to being statically tied together. The oil in the oil sump 24 will rise above the thermal baffle 65 and fill both regions 62, 63 equally. This allows the engine 38 to remain running but with higher oil temperatures since an inlet to an engine oil pump 71 will still obtain oil, such as done with a normal oil sump/oil pump geometry. This application may also be used when the engine is turned off.

Figure 7:
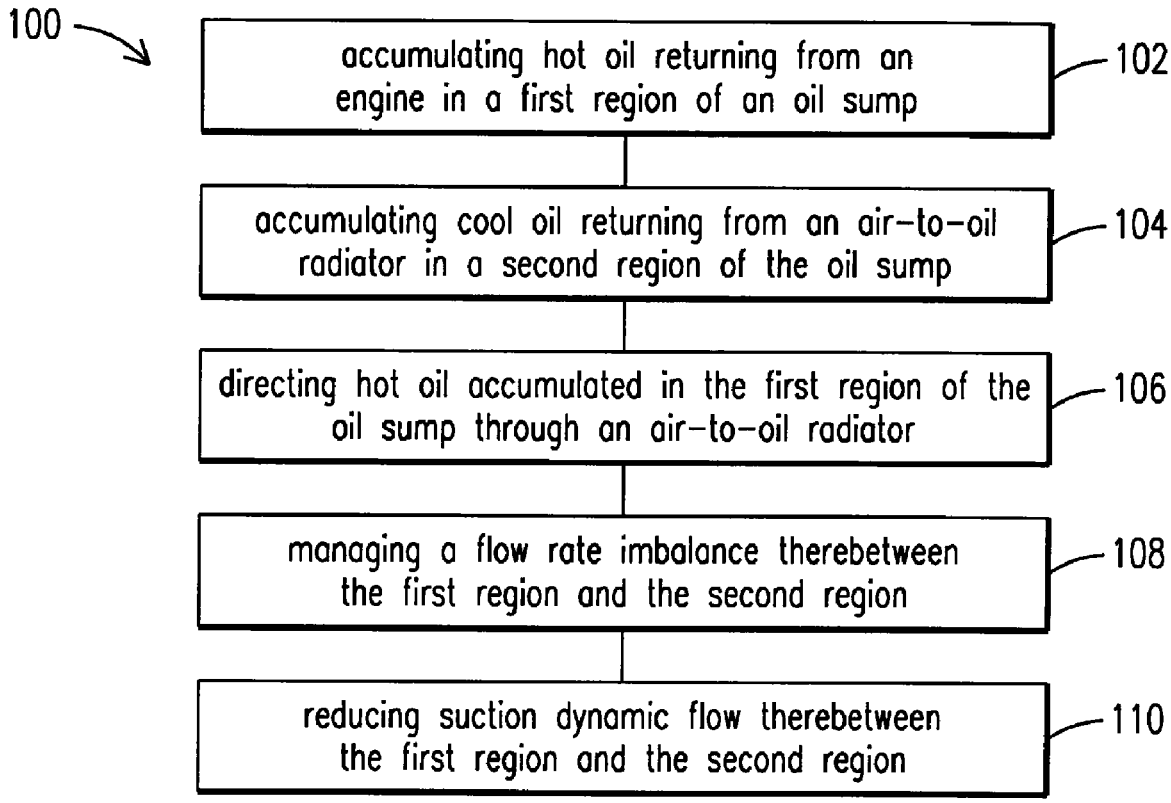
FIG. 7 depicts a flowchart illustrating an exemplary embodiment for cooling oil in an engine by eliminating a coolant based intercooler and intermediate duct.

FIG. 7 depicts a flowchart illustrating an exemplary embodiment for cooling oil in an engine by eliminating a coolant based intercooler and intermediate duct. The flowchart 100 provides for accumulating hot oil returning from an engine in a first region of an oil sump, at 102. Oil returning from an air-to-oil radiator, which hence has been cooled or is at least at a cooler temperature than oil prior to entering the radiator, is accumulated in a second region of the oil sump, at 104. Oil accumulated in the first region of the oil sump, hot oil or oil that has not been cooled, is directed through an air-to-oil radiator, at 106. A flow rate imbalance therebetween the first region and the second region is managed, at 108. If a suction dynamic flow occurrence therebetween the first region and the second region is realized, it is reduced, preferably to not having any such flow, at 110.

Figure 8:
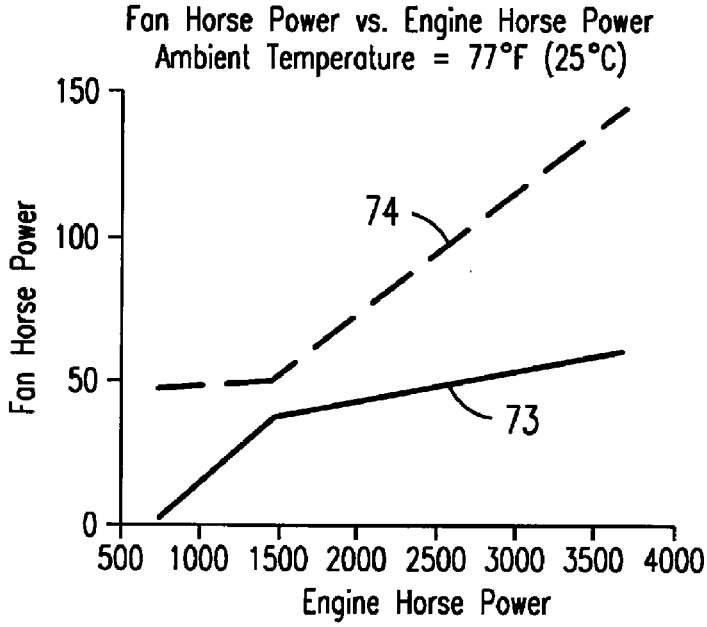
FIG. 8 depicts a graph illustrating an exemplary comparison of fan horse power versus engine horse power at a high ambient temperature.

FIG. 8 depicts a graph illustrating an exemplary comparison of fan horse power versus engine horse power at a hot ambient temperature. As graphically represented, by using an exemplary embodiment of the invention a representation 73 of fan horsepower is lowered based on the engine horsepower when at approximately 100 degrees Fahrenheit (approximately 37.78 degree Celsius) when compared to a representation 74 of existing fan horsepower.

Figure 9:
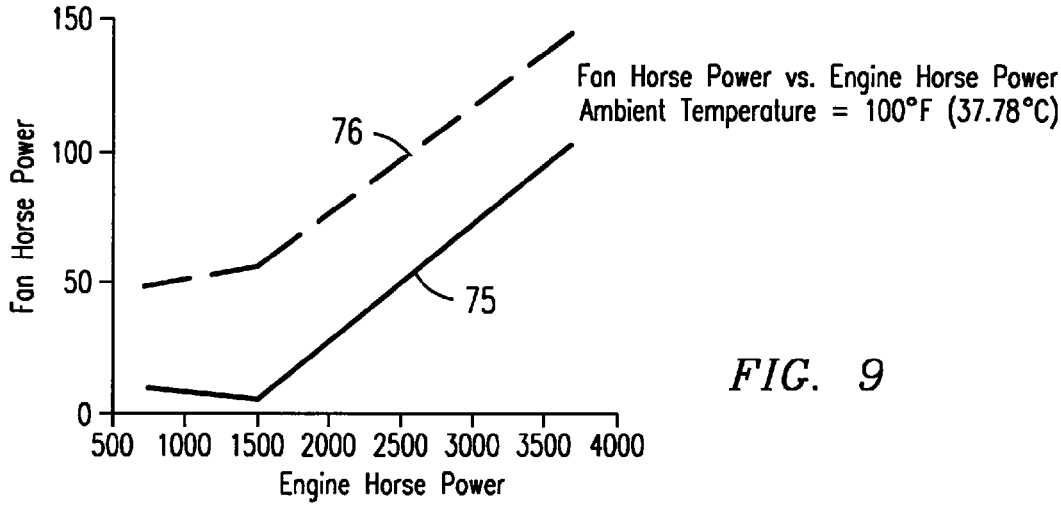
FIG. 9 depicts a graph illustrating an exemplary comparison of fan horse power versus engine horse power at a low ambient temperature.

FIG. 9 depicts a graph illustrating an exemplary comparison of fan horse power versus engine horse power at a low ambient temperature. Based on the graph realized, a representation 75 of a two fans configuration may be used to address heat loads when the ambient temperature is approximately 77 degrees Fahrenheit (approximately 25 degree Celsius) when compared to a representation 76 of an existing two fan configuration. In an exemplary embodiment a third fan may be further used for future exhaust gas recirculation heat loads.

Figure 10:
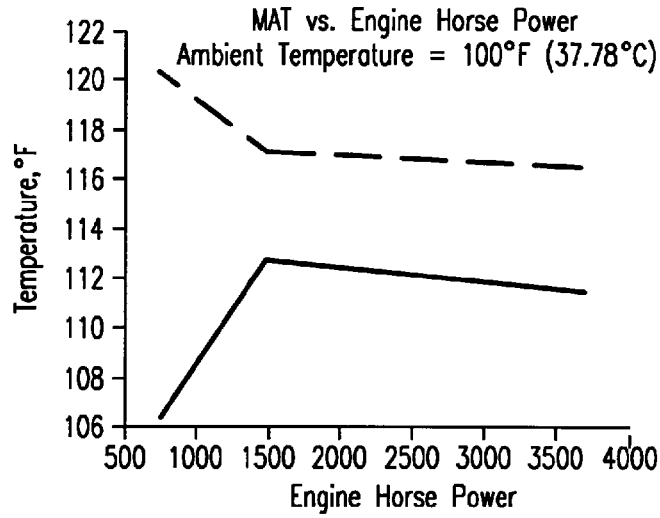
FIG. 10 depicts a graph illustrating an exemplary comparison of manifold air temperature (MAT) versus engine horse power at a high ambient temperature.

FIG. 10 depicts a graph illustrating an exemplary comparison of manifold air temperature (MAT) versus engine horse power at a hot ambient temperature. As illustrated, by using an exemplary embodiment of the invention a representation 77 of the manifold air temperature is reduced based on the engine horse power when the ambient temperature is approximately 100 degrees Fahrenheit (approximately 37.78 degree Celsius) as compared to a representation 78 of existing manifold air temperature.

Figure 11:
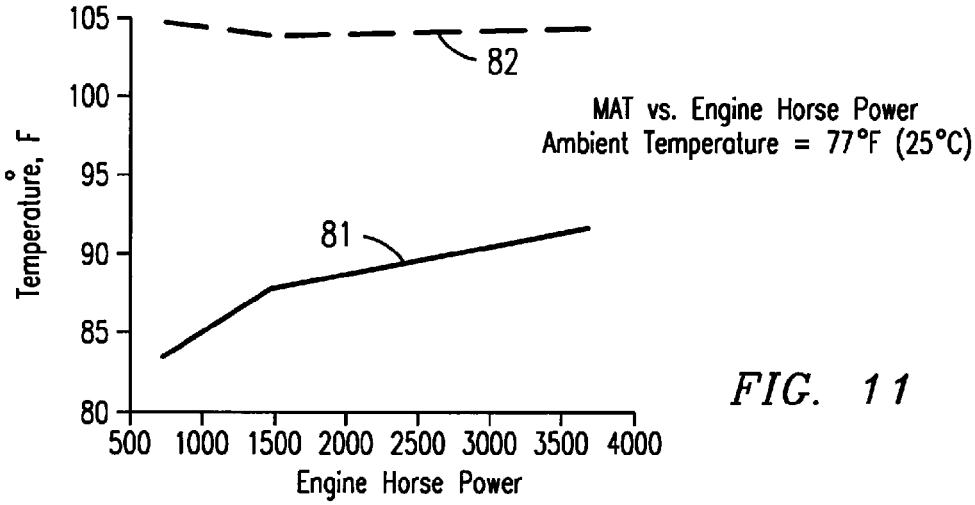
FIG. 11 depicts a graph illustrating an exemplary comparison of manifold air temperature versus engine horse power at a low ambient temperature.

FIG. 11 depicts a graph illustrating an exemplary comparison of manifold air temperature versus engine horse power at a low ambient temperature. As illustrated, by using an exemplary embodiment of the invention a representation 81 of the manifold air temperature is reduced based on the engine horse power when the ambient temperature is approximately 77 degrees Fahrenheit (approximately 25 degree Celsius) when compared to a representation of existing manifold air temperature 82.

Figure 12:
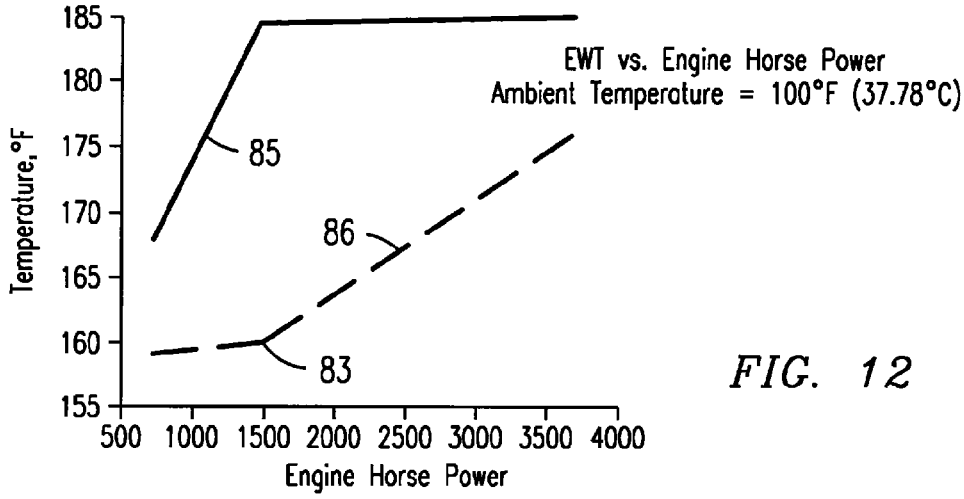
FIG. 12 depicts a graph illustrating an exemplary comparison of engine water temperature (EWT) versus horse power at a high ambient temperature.

FIG. 12 depicts a graph illustrating an exemplary comparison of engine water temperature (EWT) versus engine horse power at a high ambient temperature, such as approximately 100 degrees Fahrenheit (approximately 37.78 degree Celsius). At a switch point 83, where oil cooling switches from using the BHE 69 to using the oil-to-air radiator 16, the rate of change for the engine water temperature is improved as illustrated by a representation 85 when an exemplary embodiment of the invention is used when compared to a prior representation 86.

Figure 13:
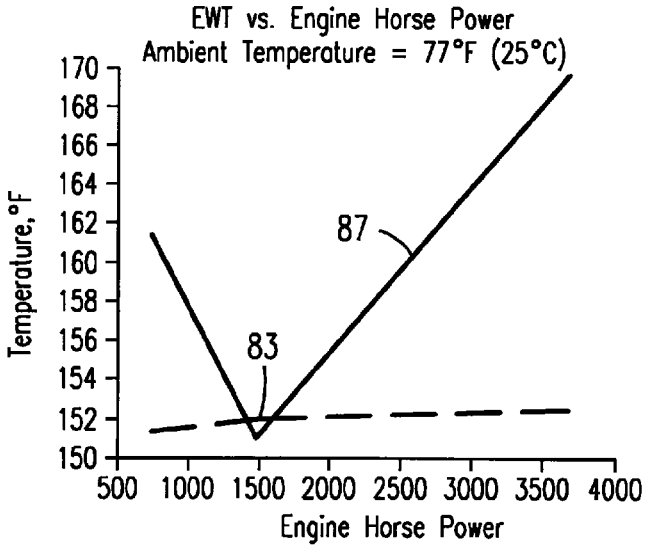
FIG. 13 depicts a graph illustrating an exemplary comparison of engine water temperature versus horse power at a low ambient temperature.

FIG. 13 depicts a graph illustrating an exemplary comparison of engine water temperature versus engine horse power at a colder ambient temperature, such as approximately 77 degrees Fahrenheit (approximately 25 degree Celsius). At the switch point 83, the temperature rises. The engine water temperature may be held low with an extra fan to hold oil temperature leaving the engine low in an original three fan concept. As illustrated by a representation 87 the engine water temperature is higher than oil with a reverse delta temperature on the piston/cylinder. Because water is hotter than oil, the combustion cylinder will expand while the piston will shrink. This will open up the clearance thus reducing the chances of piston scuffing.

Figure 14:
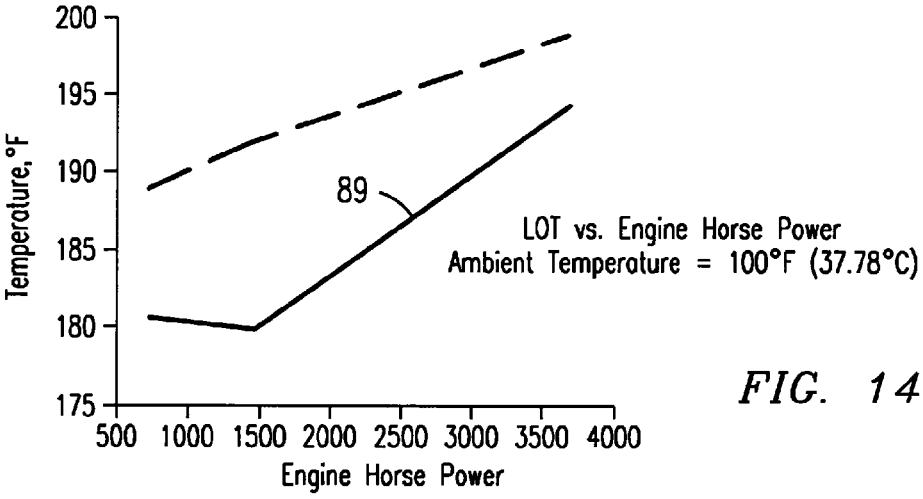
FIG. 14 depicts a graph illustrating an exemplary comparison of oil temperature leaving engine (LOT) versus engine horse power at a high ambient temperature.

FIG. 14 depicts a graph illustrating an exemplary comparison of oil temperature leaving engine (LOT) versus engine horse power at a higher temperature, such as approximately 100 degrees Fahrenheit (approximately 37.78 degree Celsius). As illustrated by a representation 89 the temperature gradually drops and then increases as the horsepower increases.

Figure 15:
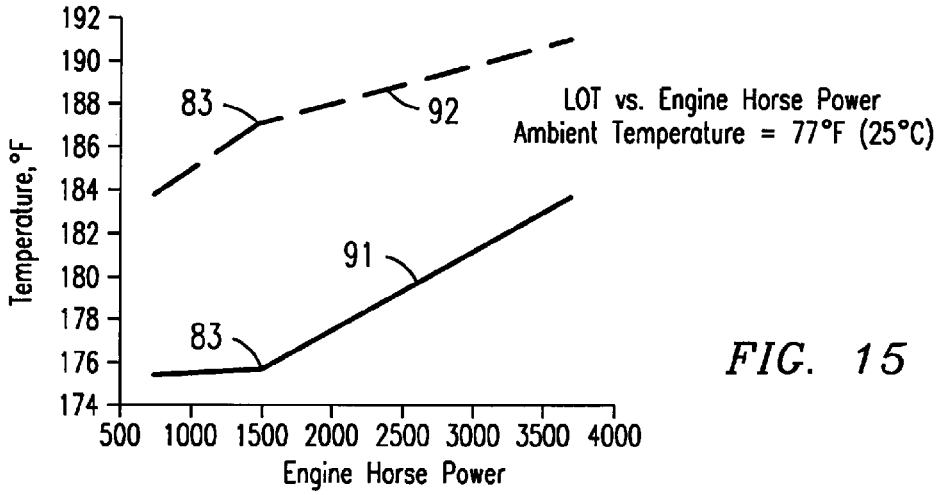
FIG. 15 depicts a graph illustrating an exemplary comparison of oil temperature leaving engine versus engine horse power at a low ambient temperature.

FIG. 15 depicts a graph illustrating an exemplary comparison of oil temperature leaving engine versus engine horse power at a lower ambient temperature, such as approximately 77 degrees Fahrenheit (approximately 25 degree Celsius). A representation 91 using an exemplary embodiment of the invention results in a lower starting temperature than the representation 92 of prior art. The temperature gradually increases at a constant rate as the horsepower increases. Upon reaching a certain horsepower, or switch point 83, the temperature increases a higher, but still constant, rate.

Figure 16:
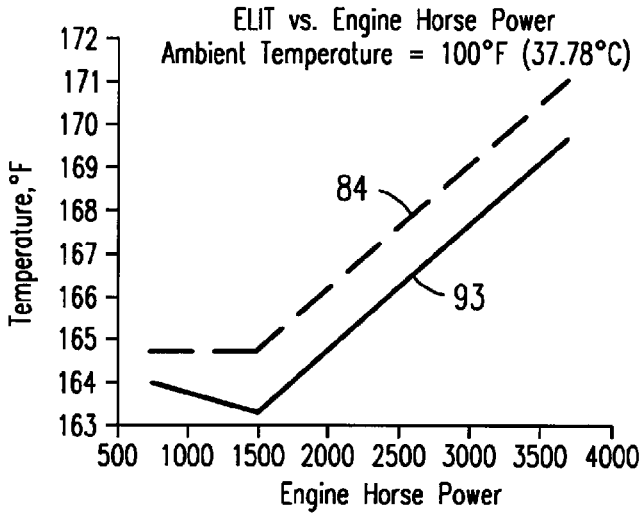
FIG. 16 depicts a graph illustrating an exemplary comparison of engine lubricating oil inlet temperature (ELIT) versus engine horsepower at a high ambient temperature.

FIG. 16 depicts a graph illustrating an exemplary comparison of engine lubricating oil inlet temperature (ELIT) versus engine horse power at a high ambient temperature, such as 100 degrees Fahrenheit (37.78 degree Celsius). As illustrated, a representation 93 using an exemplary embodiment of the invention provides for the temperature being at a lower temperature as the engine horsepower increases when compared to a representation 94 of prior art. Though air to oil cooling is realized, additional cooling is preferred. Additional cooling may be realized by utilizing longer cores. In another exemplary embodiment a higher allowable oil temperature leaving the engine may be realized.

Figure 17:
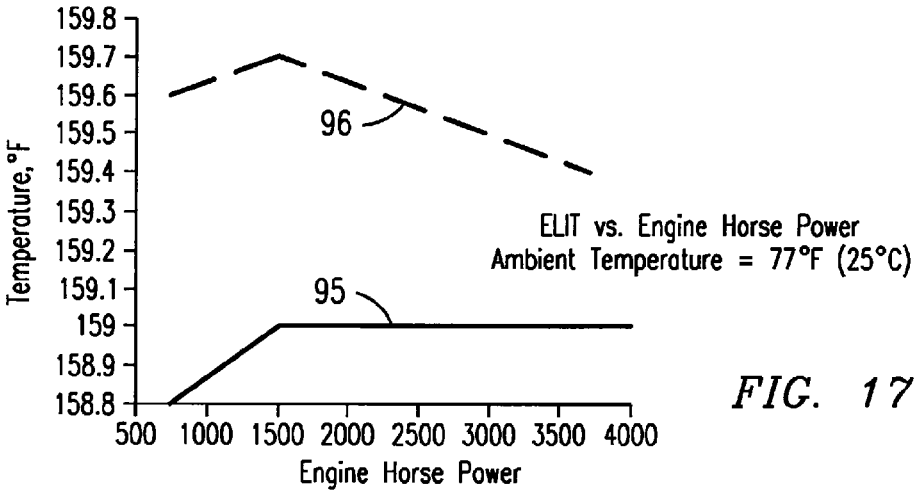
FIG. 17 depicts a graph illustrating an exemplary comparison of ELIT versus engine horsepower at a low ambient temperature.

FIG. 17 depicts a graph illustrating an exemplary comparison of ELIT versus engine horsepower at a lower ambient temperature, such as 77 degrees Fahrenheit (25 degree Celsius). As illustrated, a representation 95 illustrates that temperature starts at a lower temperature and after increasing to a certain level, the temperature remains constant as the engine horse power continues to increase. The temperature is lower than a representation 96 of a prior art embodiment.

In operation, for example, if the locomotive is idling in cold ambient temperature, a coolant based oil system may be utilized since the coolant will heat up the oil. As the locomotive transitions to a loaded condition where it experiences a moderate temperature, the coolant based oil cooler is no longer used and an air to oil cooler is used instead. When the locomotive is within a tunnel, horsepower is reduced and the air to oil cooler is turned off. The coolant based cooler is turned on. A control strategy is used to determine which cooling strategy is to be applied. Furthermore, the engine coolant temperature will rise when compared to the oil temperature when the oil leaves the engine. This in turn drives a reverse delta temperature, between the cylinder jacket and the piston. Use of coolant and air-to-oil cooling allows a change to the packaging while also resulting in minimizing the use of the air-to-oil in lower power notches, which in turn reduces duty cycle leak potential.

Though the examples and exemplary embodiments disclosed above are directed towards a locomotive, those skilled in the art will readily recognize that they may also be used with other vehicles, or powered systems, such as but not limited to marine vessels, off-highway vehicles, transportation vehicles, stationary power stations, and agricultural vehicles. Furthermore, though diesel engines are disclosed specific to locomotives, those skilled in the art will readily recognize that embodiments of the invention may also be utilized with non-diesel powered engines, such as but not limited to natural gas powered systems, bio-diesel powered systems, etc.

While the invention has been described with reference to various exemplary embodiments, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc., do not denote any order or importance, but rather the terms first, second, etc., are used to distinguish one element from another.

What is claimed is:

1. A system for cooling an engine, comprising:

an air-to-oil radiator system configured to cool oil that flows through the engine;

an air-to-air radiator system comprising an air-to-air radiator, a first air flow including cooling air flowing through the air-to-air radiator, and a second air flow including combustion air flowing through the air-to-air radiator, the air-to-air radiator system configured to cool the combustion air;

a coolant radiator configured to cool an engine coolant and to provide the cooled engine coolant to the engine; and an engine oil sump in communication with the engine, the engine oil sump comprising at least a first region and a second region to manage a flow of oil, wherein the cooling air flows from the air-to-air radiator system through the air-to-oil radiator system and then through the coolant radiator, oil flows from the first region out a first location of the sump to the air-to-oil radiator system and then flows into the second region of the sump, and oil flows from the second region out a second location of the sump to the engine.

2. The system according to claim 1, further comprising a controller, wherein the system is without a coolant based intercooler and without an intermediate duct, and the air-to-oil radiator system and the coolant radiator are both simultaneously operable by the controller.

3. The system according to claim 1, wherein the first region is configured to accumulate hot oil returning from the engine and the second region is configured to accumulate cooler oil returning from the air-to-oil radiator system.

4. The system according to claim 1, wherein oil leaving the engine is deposited into the engine oil sump as acted upon by gravity, wherein oil falling over the second region is directed into the first region.

5. The system according to claim 1, further comprising a first baffle positioned therebetween the first region and the second region with at least one communication hole disposed therethrough the first baffle to at least partially equalize a flow rate imbalance realized between the first region and the second region.

6. The system according to claim 5, further comprising a second baffle having a lower height than the first baffle and further configured to suction dynamic flow from the first region through the at least one communication hole.

7. The system according to claim 1, further comprising a surge tank configured to capture overflow oil from the engine oil sump.

8. The system according to claim 1, wherein the air-to-air radiator system, the air-to-oil radiator system, and the coolant radiator operate in conjunction with one another via the flow of cooling air therethrough.

9. The system according to claim 1, wherein the air-to-oil radiator system only receives oil from the first region and the engine only receives oil from the second region.

10. The system according to claim 1, further comprising a first oil circuit including oil flowing from the first region to the air-to-oil cooler and a second oil circuit including oil flowing from the second region to the engine, wherein the first oil circuit is arranged in parallel to the second oil circuit.

11. The system according to claim 1, further comprising a first oil pump pumping oil from the first region to the air-to-oil cooler and a second oil pump pumping oil from the second region to the engine.

* * * * *